US007619574B1

(12) United States Patent
West

(10) Patent No.: US 7,619,574 B1
(45) Date of Patent: Nov. 17, 2009

(54) TUNABLE ANTENNA

(75) Inventor: James B. West, Cedar Rapids, IA (US)

(73) Assignee: Rockwell Collins, Inc., Cedar Rapids, IA (US)

( * ) Notice: Subject to any disclaimer, the term of this patent is extended or adjusted under 35 U.S.C. 154(b) by 195 days.

(21) Appl. No.: 11/904,366

(22) Filed: Sep. 27, 2007

(51) Int. Cl.
*H01Q 1/28* (2006.01)
*H01Q 1/38* (2006.01)
*H01Q 9/00* (2006.01)
*H01Q 3/24* (2006.01)

(52) U.S. Cl. ..... 343/705; 343/700 MS; 343/745; 343/876

(58) Field of Classification Search ..... 343/700 MS, 343/705, 745, 846, 860, 876, 893
See application file for complete search history.

(56) References Cited

U.S. PATENT DOCUMENTS 3,475,703 A * 10/1969 Kennedy et al. ..... 333/17.1
4,939,525 A * 7/1990 Brunner ..... 343/745
4,973,972 A * 11/1990 Huang ..... 343/700 MS

* cited by examiner

*Primary Examiner*—Shih-Chao Chen
(74) *Attorney, Agent, or Firm*—Daniel M. Barbieri

(57) ABSTRACT

A tunable antenna comprises a conductor, a shunt inductance tuning element, a switch that controls the shunt inductance tuning element and the conductor, and a local ground connected to the shunt inductance tuning element. The switch is capable of activating the shunt inductance tuning element to change a frequency and bandwidth of the tunable antenna.

17 Claims, 6 Drawing Sheets

TUNABLE ANTENNA

TECHNICAL FIELD

The present invention generally relates to the field of antennas, and more particularly to tunable antennas, such as wide band antennas for software defined radio applications.

BACKGROUND

Antennas are utilized for communication. Aircrafts rely on communication. Special considerations are considered when utilizing an antenna on an aircraft and/or other moving vehicles and devices.

Monopole antennas are typically vertically polarized antenna structure. Monopole antennas can be thought of as replacing one half of a dipole antenna with a ground plane at a right-angle to another half. Monopole antennas are typically large and/or non-aerodynamic. A dipole antenna may have two conductors pointed in opposite directions with one end of a conductor attached to a radio and one end of the other conductor hanging free in space. A dipole and a monopole antenna may be positioned vertically or horizontally and are omnidirectional in azimuth with a low gain. Both monopole and dipole antennas are inherently narrowband since they are fundamentally resonant structures.

Broadband multi-arm spiral antennas provide an omni type radiation patterns over a wide bandwidth. Broadband multi-arm spiral antennas require complicated BALUN networks (e.g., a passive electrical device that converts between balanced and unbalanced radio frequency electrical signals). Moreover, broadband multi-arm spiral antennas typically have large diameters and no capability for dynamic impedance tuning for an electronically scanned arrays (ESA).

SUMMARY

The disclosure is directed to a tunable antenna.

The tunable antenna may comprise a conductor, a shunt inductance tuning element, a switch that controls the shunt inductance tuning element and the conductor, and a local ground connected to the shunt inductance tuning element. The switch is capable of activating the shunt inductance tuning element to change a frequency and bandwidth of the tunable antenna.

The tunable antenna may comprise a conductor, a tuning element, the tuning element comprising at least one of microelectromechanical variable capacitors, ferroelectric variable capacitors, and switched line length transmission line stubs, and a local ground connected to the tuning element. The tuning element is capable changing a frequency and bandwidth of the tunable radiating element It is to be understood that both the foregoing general description and the following detailed description are exemplary and explanatory only and are not necessarily restrictive of the claims. The accompanying drawings, which are incorporated in and constitute a part of the specification, illustrate examples and together with the general description, serve to explain the principles of the disclosure.

BRIEF DESCRIPTION OF THE DRAWINGS

The numerous advantages of the disclosure may be better understood by those skilled in the art by reference to the accompanying figures in which.

DETAILED DESCRIPTION

Figure 1:
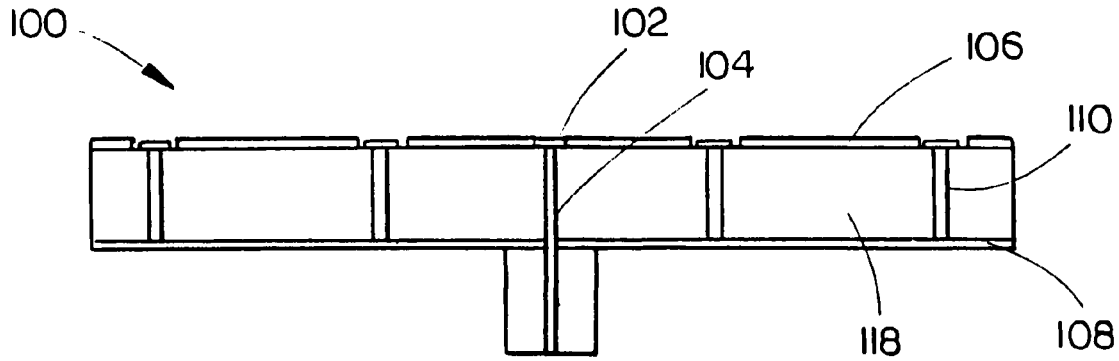
FIG. 1 is a cross-sectional side view illustrating a tunable antenna.

Referring to FIGS. 1 through 6, a tunable antenna 100 is shown. The tunable antenna 100 may be capable of transmitting and/or receiving radio waves. The tunable antenna 100 may be small in size and tunable over a broad bandwidth. The tunable antenna 100 may be tunable within the very high frequency band (VHF) (with a frequency of 30 MHz to 300 MHz and a wavelength of 10 m to 1 m), the ultra high frequency band (UHF) (with a frequency of 300 MHz to 3,000 MHz and a wavelength of 1 m to 100 mm), the super high frequency band (SHF) (with a frequency of 3 GHz to 30 GHz and a wavelength of 100 mm to 10 mm), and the extremely high frequency band (EHF) (with a frequency of 30 GHz to 300 GHz and a wavelength of 10 mm to 1 mm). The tunable antenna 100 may have greater than a 5 to 1 resonant frequency tuning within the above stated bands. Moreover, the tunable antenna 100 may have a variable instantaneous bandwidth by being able to dynamically change the center frequency (or the resonant frequency at a centered coaxial input). It is appreciated that the frequency transmitted/received by the tunable antenna 100 may be related to the diameter of the tunable antenna 100. The relationship may be a first order relationship.

The tunable antenna 100 may be employed with software defined radio systems and/or may be an electronically scanned antenna. The tunable antenna 100 may be utilized in an aircraft. As used herein the term "aircraft" refers to a vehicle or craft that is able to fly through the air. The tunable antenna 100 may also be utilized with munitions, ground vehicles, water vehicles and/or any other suitable devices that may utilize an antenna.

The tunable antenna 100 may be in any suitable shape or size. The tunable antenna 100 may be in a circular shape. The tunable antenna 100 may be conformal or have the ability to conform to the surface of the object from which the tunable antenna 100 is attached. The tunable antenna 100 may have the ability to be mounted flush against the surface of the object from which the tunable antenna 100 is attached. The tunable antenna 100 may be aerodynamic and/or have a low drag. The tunable antenna 100 has the ability to be conformal and/or aerodynamic because the diameter and/or the longest plane of the tunable antenna 100 may be only about 0.14 of a wavelength with a height of 0.01 wavelengths at the tunable antenna's lower operating frequency. The diameter of the tunable antenna 100 may be about one centimeter and may have an operating frequency of about 3 GHz. The size/diameter of the tunable antenna 100 may be scalable to the desired frequency. The size/diameter of the antenna may be configured to have a 0.14 wavelength with a height of 0.01 wavelengths in diameter of the optimal wavelength being transmitted.

The tunable antenna 100 may comprise a conductor 106, a shunt inductance tuning element 110, a switch 112, and a local ground 108. The tunable antenna 100 may comprise a conductor 106, a tuning element, and a local ground 108

The tunable antenna 100 may further comprise a dielectric material 118, a centered coaxial input 102, a coaxial cable 104, a direct current bias circuit 114, a platform ground with a local ground, and/or a direct circuit ground 116 with the local ground 108.

The local ground 108 may be any metallic surface that is the same size or larger than the tunable antenna 100. The local ground 108 may comprise material such as copper, silver, gold, and/or any other suitable conductor with high radio frequency conductivity. The local ground 108 may be connected to a platform ground 120. The platform ground 120 may be the outer surface of an aircraft. The platform ground 120 may be the fuselage of the aircraft. The platform ground 120 may be the wing of the aircraft. The platform ground 120 may be a shell of munitions, such as an artillery shell.

The centered coaxial input 102 extends through the center of the dielectric material 118 with one side of the dielectric material 118 covered, coated, and/or joined to the conductor 106 as illustrated in FIGS. 1, 3, 5, and 6. The centered coaxial input 102 may transmit radio waves though a coaxial cable 104. The centered coaxial input 102 may transmit radio waves to and/or from a radio.

The dielectric material 118 may be any suitable non-conductive material for an antenna, such as ceramic, glass, and/or plastics. The conductor 106 may be any suitable conductive material for an antenna, such as copper, silver, gold, and/or any other suitable conductor with high radio frequency conductivity. The conductor 106 may be a circular metal plate.

The shunt inductance tuning element 110 may extend through the dielectric material 118 to the plane of the conductor 106, but the shunt inductance tuning element 110 does not touch the conductor 106 as illustrated in FIGS. 1 through 6. The shunt inductance tuning element 110 may be similar in manner to that of small monopole type antennas. However, the shunt inductance tuning elements 110 of the tunable antenna are embedded in the internal fields of the tunable antenna 100 unlike the typical monopole antenna where the inductive loading is at the input/output terminal of the monopole antenna.

At least one shunt inductance tuning element 110 may be integrated in the dielectric material 118. A plurality of shunt inductance tuning elements 110 may be integrated in the dielectric material 118. The tunable antenna 100 may create a monopole like pattern that is tunable in frequency due to the plurality of the shunt inductance turning elements 110. The dielectric material 118 may support two or more shunt inductance tuning elements 110. The dielectric material 118 may support four shunt inductance tuning elements 110. The dielectric material 118 may support six shunt inductance tuning elements 110. The dielectric material 118 may support eight shunt inductance tuning elements 110. It is appreciated that the number, geometry, and location of the shunt inductance tuning elements may be designed to provide desired tuning impedance matching.

Figure 2:
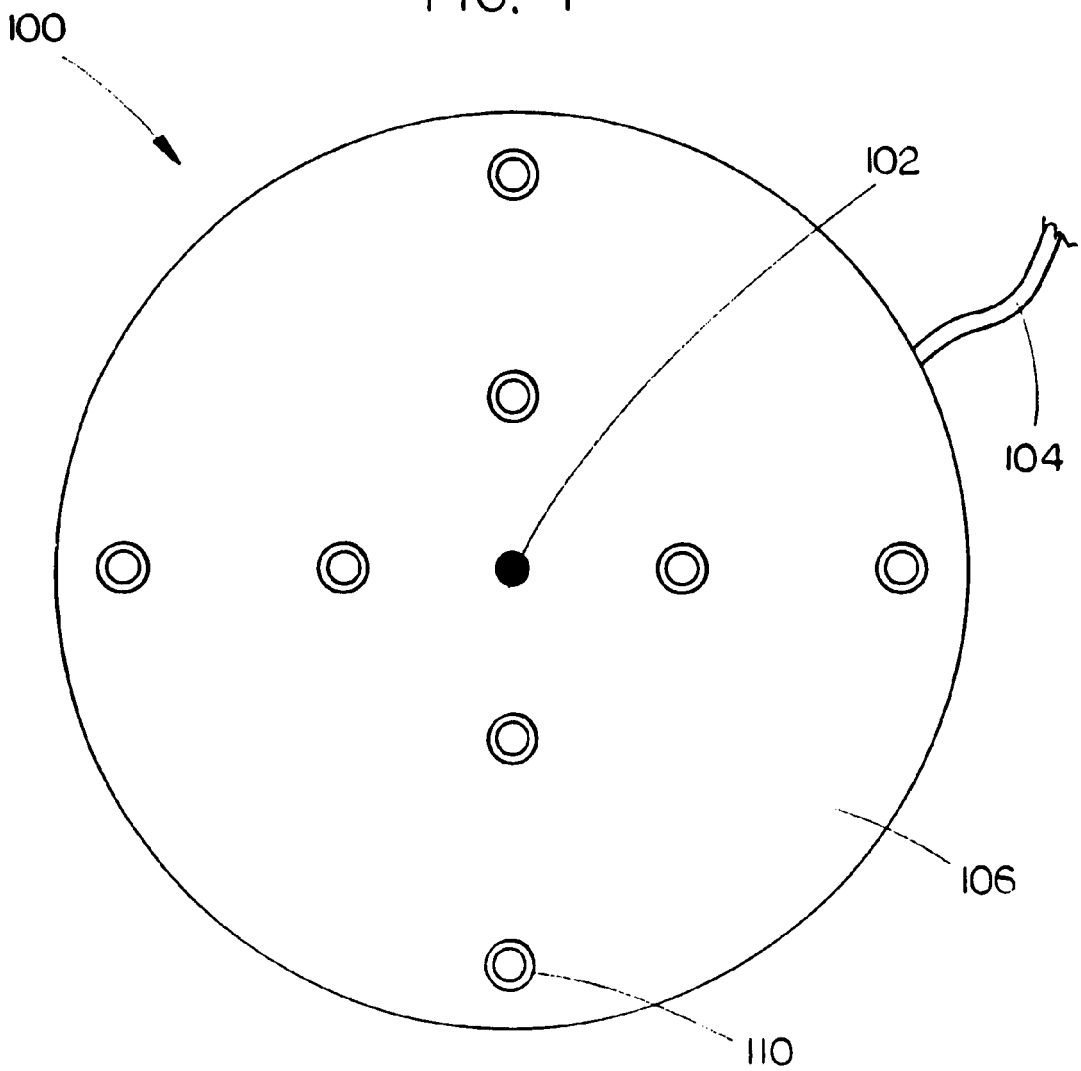
FIG. 2 is a top view illustrating a tunable antenna.

The shunt inductance tuning elements 110 may be in any suitable configuration within the dielectric material 118 for adjusting the center frequency of the tunable antenna 100. The shunt inductance tuning elements 110 may be positioned in a line radially outward from the centered coaxial input 102. The shunt inductance tuning elements 110 may be positioned in two different perpendicular lines that extend radially outward from the centered coaxial input 102 as illustrated in FIG. 2. The shunt inductance tuning elements 110 may be integrated into the dielectric material 118 in a configuration that is not uniform and/or that does not create a grid.

It is appreciated that the size and shape of the portion of the shunt inductance tuning element 110 that is on same plane as the conductor 106 or the head of the shunt inductance tuning element 110 may be configured for changing the center frequency of the tunable antenna 100. The head of the shunt inductance tuning element 110 may be in a circular shape. If a plurality of shunt inductance tuning elements 110 are utilized in the tunable antenna 100, then the heads of each of the shunt inductance tuning elements 110 may be the same size and/or shape or may vary in size and/or shape.

Figure 3:
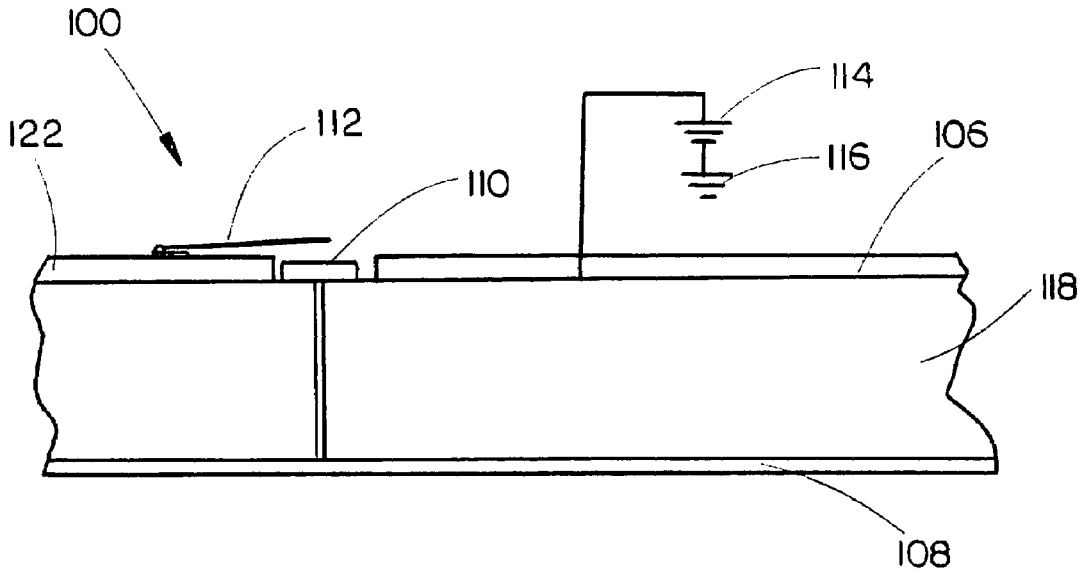
FIG. 3 is a partial, cross-sectional side view illustrating a tunable antenna.
Figure 4:
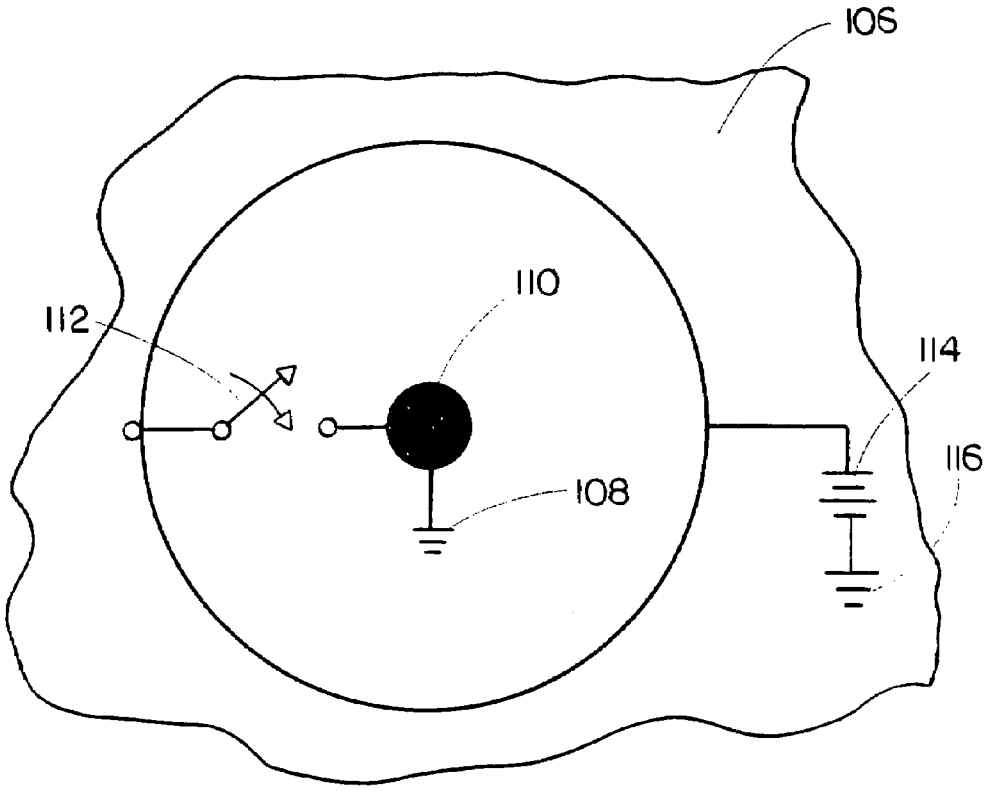
FIG. 4 is a circuit diagram of a switch of the tunable antenna illustrated in FIG. 3.

The tunable antenna 100 may comprises a plurality of switches 112. The tunable antenna 100 may comprises a switch 112 for every shunt inductance tuning elements 110 present in the tunable antenna 100. The switch 112 may be positioned to connect the conductor 106 and the shunt inductance tuning element 110 when in a closed position, as illustrated in FIGS. 1 through 6. Closing the switch 112 (e.g., establishing a connection within the antenna) activates the shunt inductance tuning element 110 and changes the center frequency of the tunable antenna 100. Referring to FIG. 4 a circuit diagram of the switch illustrated in FIG. 3 is shown.

The switch 112 may be opened or closed by a power from a direct current (DC) source connected to the tunable antenna 100. If a plurality of switches 112 is utilized in the tunable antenna 100, then the plurality of the switches 112 may have a common voltage. A direct current bias circuit 114 may open or close the switch 112 as illustrated in FIGS. 3 and 4. The switch 112 may comprise a microelectromechanical system (MEMS), a p type semiconductor-intrinsic semiconductor-n type semiconductor (PIN), and/or a transistor radio frequency switches. This list is not restrictive. It is contemplated that any suitable radio frequency switch 112 for a tunable antenna 100 may be utilized without departing from the scope and intent of the disclosure. Moreover, the switch 122 may utilize flip chip mounting concepts.

As already described a side of the dielectric material 118 is covered, coated, and/or joined to the conductor 106. A second side of the dielectric material 118 parallel and opposite the conductor 106 may be covered, coated, and/or joined to a local ground 108 as illustrated in FIGS. 1, 3, 5, and 6. A radio frequency potential exist between the conductor 106 and the local ground 108 and may initiate an internal field to cause radiation to leak off the edge of the tunable antenna 100. The shunt inductance tuning elements 110 that traverse the dielectric material 118 may connect to the local ground as illustrated in FIGS. 1, 3, 5, and 6. It is appreciated that no direct current continuity exists between 106 and 108 unless the switch 112 is activated. The local ground 108 may be connected to a direct circuit 116. The local ground 108 may be connected to or may be the same structure as the platform ground 120.

The tunable antenna 100 may comprise a first tunable radiating element 122 and at least a second tunable radiating element 122 configured to form an array. The tunable radiating element 122 may be in any suitable shape or size. The tunable radiating element 122 may be in a circular shape. The tunable radiating element 122 may be conformal or have the ability to conform to the surface of the object the tunable radiating element 122 is attached to. The tunable radiating element 122 may have the ability to mounted flush against the surface of the object the tunable radiating element 122 is attached to. The tunable radiating element 122 may be aerodynamic and/or have a low drag. The diameter and/or the longest line on a plane of the tunable radiating element 122 may be about one tenth of a wavelength at the tunable radiating element's lower operating frequency. A tunable radiating element 122 with a diameter of 1.4 centimeters may have an operating frequency of approximately 3 GHz. The size of the tunable radiating element 122 may be scalable to the desired frequency. The tunable radiating element 122 may be a tunable C disk.

The tunable radiating element 122 may comprise a conductor 106, a shunt inductance tuning element 110, a switch 112, and a local ground 108. The conductor 106, the shunt inductance tuning element 110, the switch 112, and the local ground 108 of the tunable radiating element 122 are the same as the conductor 106, the shunt inductance tuning element 110, the switch 112, and the local ground 108 as described above.

Typically, array antennas have parasitic mutual coupling between their different elements causing deleterious interference (mutual coupling) within the antenna. The mutual coupling effect is a function of the spacing and the relative phase on each of the elements during beam scanning in the typical antenna array.

The tunable radiating elements 122 of the tunable antenna 100 may be part of an electrically scanned antenna. Phase shifters or true time delay devises initiate the required phase shift to steer the beam. Mutual coupling causes the impedance of each radiation element to vary as a function of beam scanning, this effect may be called active scan impedance and typically deteriorates electronic scan performance. The tunable radiating elements 122 in the array may be dynamically adjusted to ensure a proper impedance match as the array is electrically scanned (e.g., the dynamic tuning of the radiating element may be utilized to offset the undesirable effects of mutual coupling when scanning the array). The direct current (DC) control signal may be utilized to open or close the switches 112 to change the active shunt inductance tuning elements 110 to compensate and/or offset the parasitic mutual coupling. Therefore, the tunable antenna 100 comprising an array has a dynamic scan impedance adjustment to compensate for the parasitic mutual coupling of the array. Moreover, the tunable antenna 100 does not require the utilization of a complex BALUN network, unlike other wide bandwidth antennas. The array may be a wide scan end fire electronic scanned antenna application required for aircraft platform.

The opening and closing of the switches 112 may be selectively chosen in real time for tuning the antenna and/or preventing parasitic mutual coupling. The selection may calculated and/or chosen by software in the software define radio and/or in the scanning of the electric scan antenna. Other technologies such as microelectromechanical system variable capacitors, ferroelectric variable capacitors, and/or switched length transmission line stubs, referred to herein as a "tuning element" or collectively as "tuning elements", may be utilized in conjunction with or instead of the shunt inductance tuning element 110 to prevent parasitic mutual coupling and/or to tune the center frequency of the tunable radiating elements 122 and the tunable antenna 100. This list is not restrictive. It is appreciated that any suitable mechanism for tuning the center frequency or providing variable impedance circuit elements for the tunable antenna 100 may be utilized without departing from the scope and intent of the disclosure.

It is contemplated that the number of, the size of, and the positioning of the shunt inductance tuning elements 110 may be adjusted to affect the impedance match and/or resonant frequency and therefore it is appreciated that the tunable antenna's bandwidth may be adjusted for desired applications by repositioning the shunt inductance tuning elements 110 and increasing the amount of shunt inductance tuning elements 110. Similarly, it is contemplated that the number of shunt inductance tuning elements 110 and the positioning of the shunt inductance tuning elements 110 may be adjusted to affect the radiation pattern in an azimuth plane. Therefore, it is appreciated that the tunable antenna's radiated phase in the azimuth plane may be adjusted for desired applications by repositioning the shunt inductance tuning elements 110 and increasing the amount of shunt inductance tuning elements 110.

The size and/or diameter of the tunable antenna and/or the shunt inductance tuning elements 110 may be functionally related to the diameter of the wavelength the tunable antenna receives and/or transmits. The tunable antenna 100 and/or the tunable radiating element 122 may be configured to have a 0.14 wavelength in diameter with a height of 0.01 wavelengths of the optimal wavelength being transmitted and/or received at 300 Mhz. This relationship allows the tunable antenna 100 to be conformal and/or aerodynamic.

The tunable antenna 100 may be tunable over a wide range of center frequencies by closing the switch 112 to activate the shunt inductance tuning element 110 in the plurality of tunable radiating elements 122. The activation of the shunt inductance tuning element 110 allows the tunable antenna 100 to be designed to transmit and/or receive frequency bands, such as VHF bands, UHF bands, SHF bands, or EHF bands, which include the L band, the Ka band, and the Ku band. The VHF band through the L band tuning may have a greater than 5 to 1 resonant tuning frequency for avionic software defined radio systems and for communication, navigation, and/or surveillance radio systems.

The tunable antenna 100 may be vertically and/or horizontally polarized as illustrated in FIGS. 5 and 6.

Figure 5A:
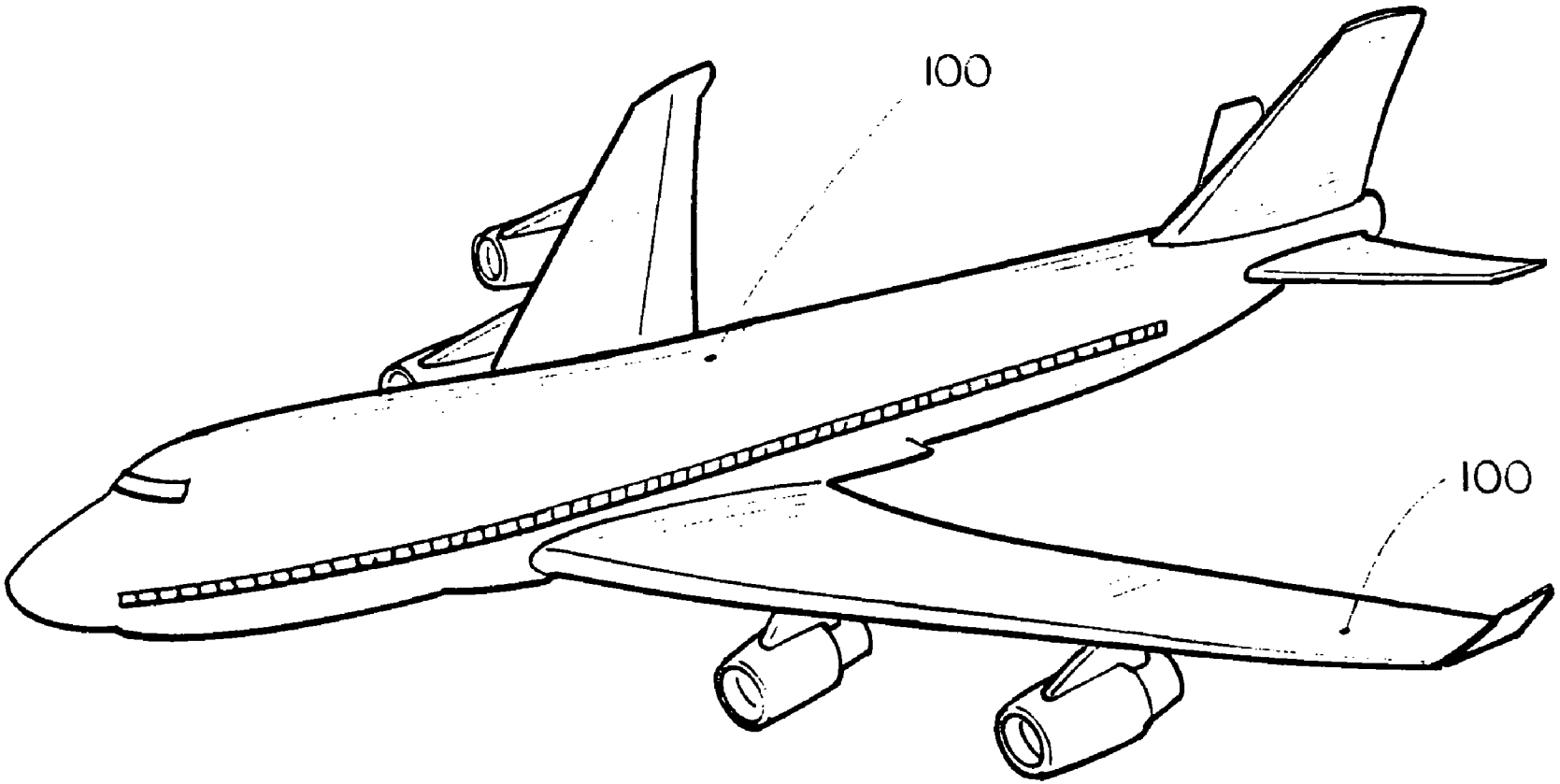
FIG. 5A is an isometric view illustrating two tunable antennas mounted to an aircraft with a vertical polarization.
Figure 5B:
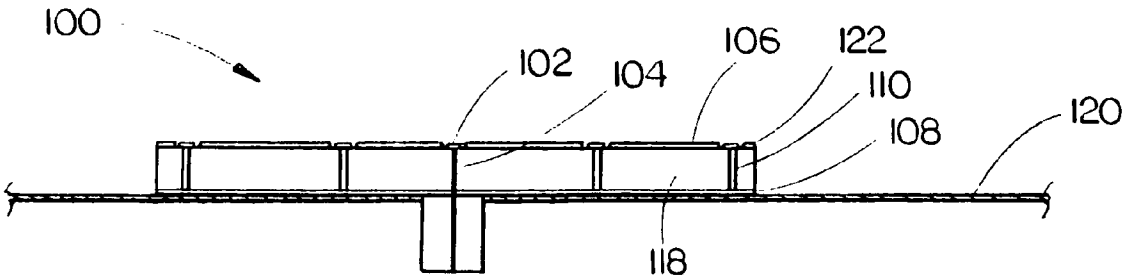
FIGS. 5B and 5C is a cross-sectional side view of the tunable antennas mounted to the aircraft with the vertical polarization as illustrated in FIG. 5A.
Figure 5C:
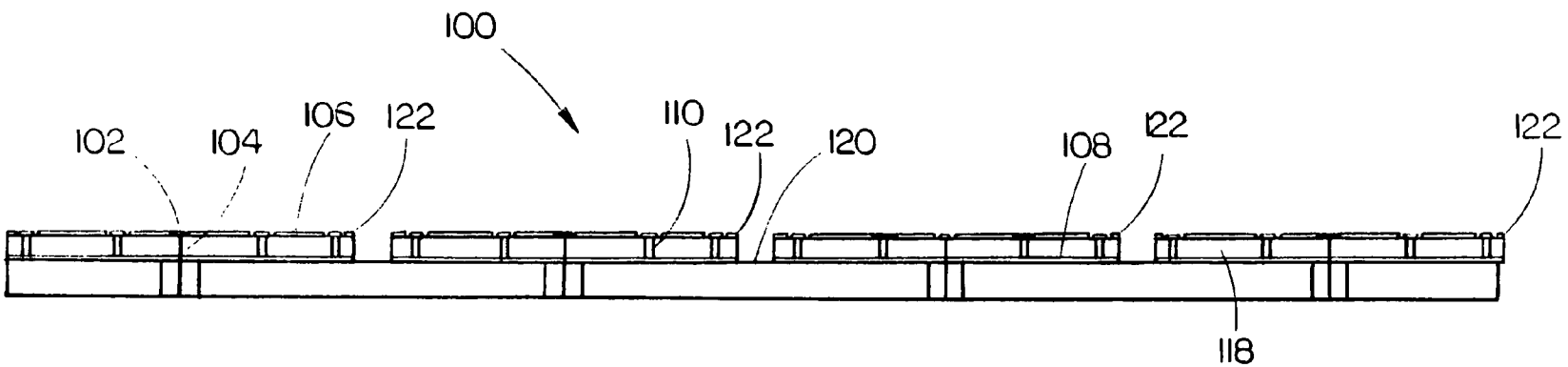

The vertically polarized tunable antenna 100 may be mounted to the fuselage or the wing, as illustrated in FIGS. 5A, 5B, and 5C. The vertically polarized tunable antenna 100 may be an end fire array, as illustrated in FIGS. 5A and 5C. The array of the vertically polarized tunable antenna 100 may contain four tunable radiating elements 122 attached to the same platform ground 120, as illustrated in FIG. 5C. It is appreciated that number of tunable radiating elements 122 in the array may vary depending upon the desired utilization of the tunable antenna 100.

Figure 6A:
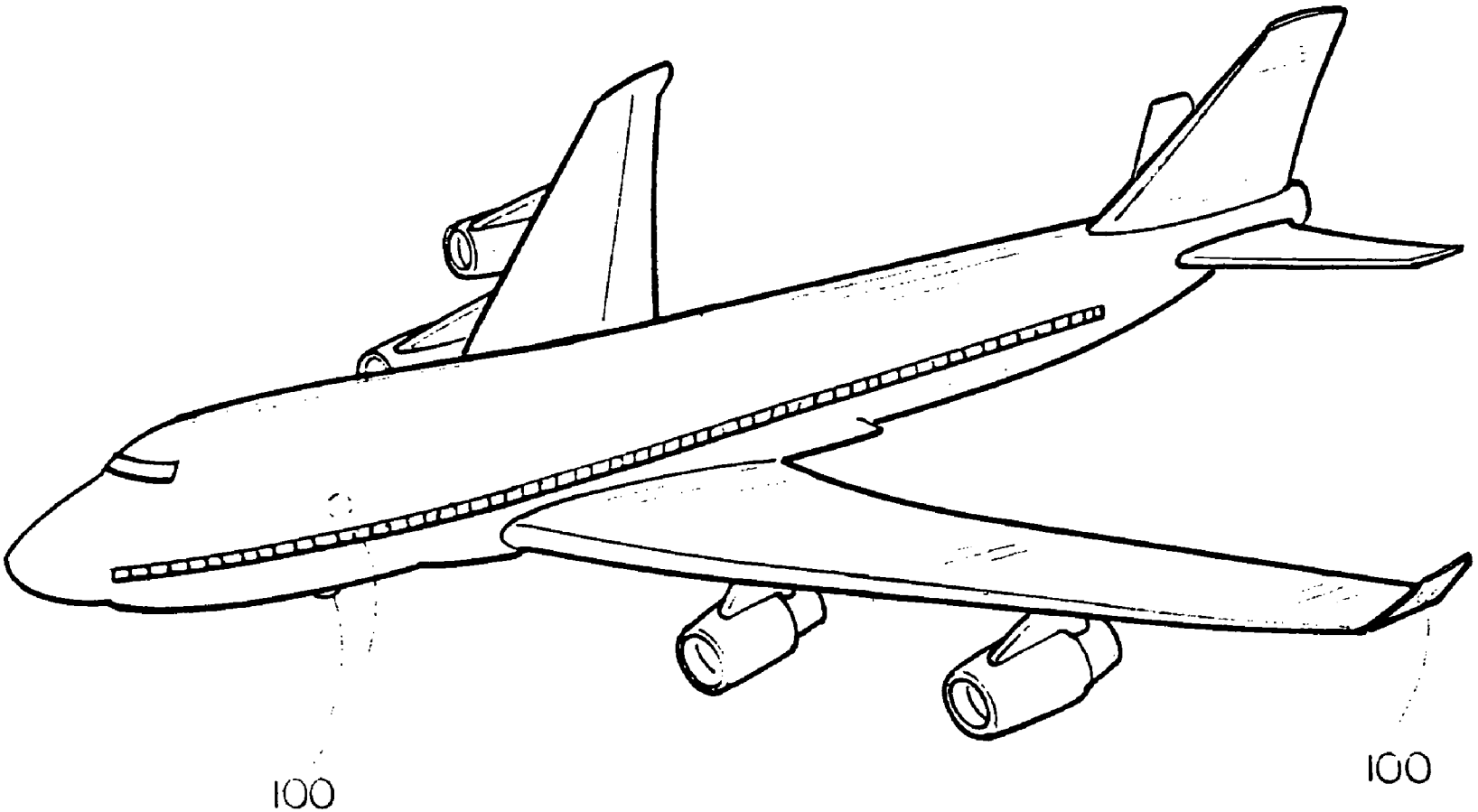
FIG. 6A, is an isometric view illustrating two tunable antennas mounted to an aircraft with a horizontal polarization.
Figure 6B:
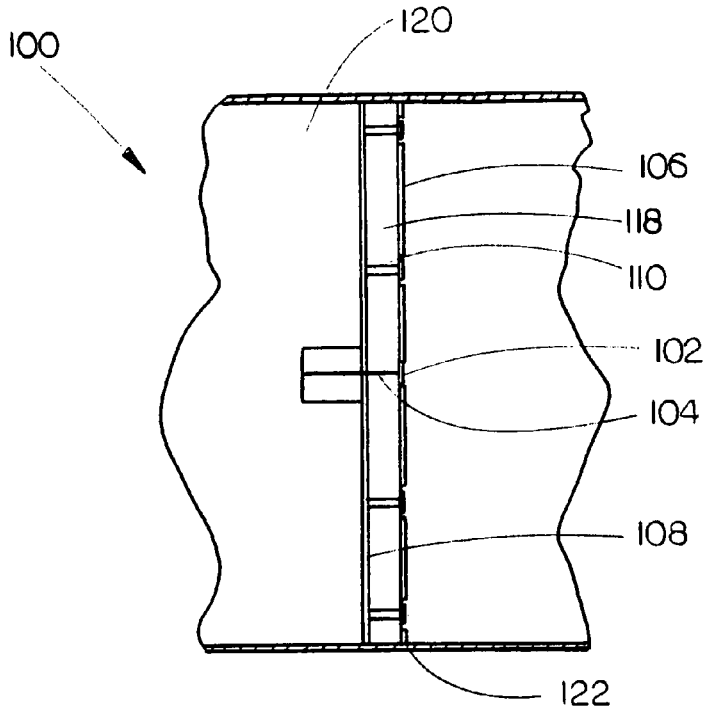
FIGS. 6B and 6C is a cross-sectional side view of the tunable antennas is mounted to the aircraft with the horizontal polarization as illustrated in FIG. 6A.
Figure 6C:
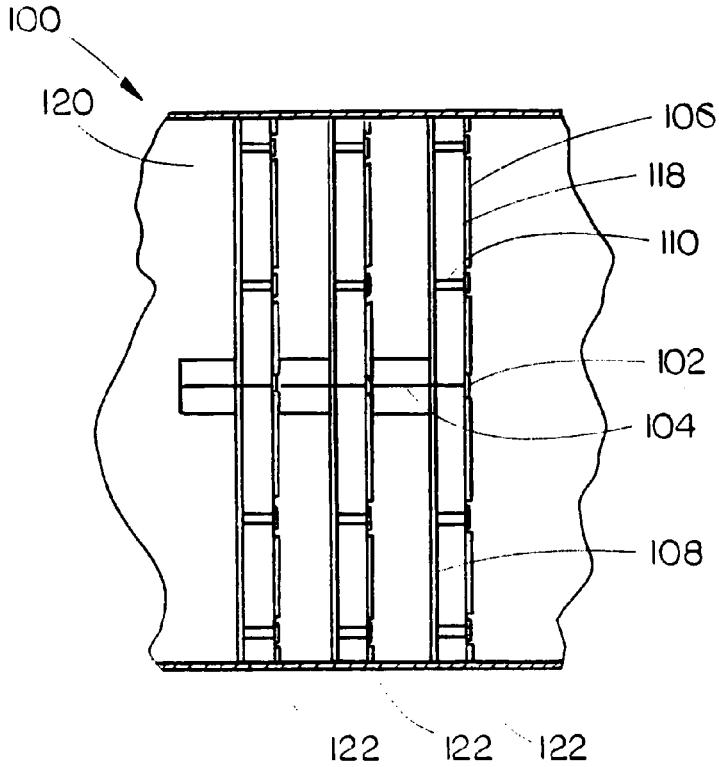

The horizontally polarized tunable antenna 100 may be contained within a wing, the fuselage, or a cylindrical pod on an aircraft, as illustrated in FIGS. 6A, 6B, and 6C. The horizontally polarized tunable antenna may be contained within the fuselage axis of munitions. The horizontally polarized tunable antenna may be in an array, as illustrated in FIG. 6C. The horizontally polarized array tunable antenna 100 may comprise three tunable radiating elements 122 all connected to the same platform ground 120, as illustrated in FIG. 6C. It is appreciated that number of tunable radiating elements 122 in the array may vary depending upon the desired utilization of the tunable antenna 100.

The tunable antenna 100 may be applicable to highly integrated antenna technology. The tunable antenna 100 may have a radiation pattern similar to a vertically polarized monopole in a fuselage mount configuration; a vertically polarized fuselage and wing mount directional end fire array configuration; a monopole horizontally polarized pod mount configuration; and a monopole horizontally polarized pod mount directional end fire array configuration. These configurations may be tunable over the VHF band through the L band in 5 to 1 resonant tuning segments for software defined radio systems and/or for communication, navigation, and/or surveillance radio systems. The basic architecture of the tunable antenna may also be scaled to cover a 5 to 1 center frequency tuning over other bands. These configurations and tuning segment may be utilized in avionic applications. The tunable antenna 100 may be in the vertically polarized fuselage mount configuration and may have azimuthally symmetric patterns.

The tunable antenna 100 may be in an end fire array configuration. When the tunable antenna 100 may be used in an end fire non-scanned array and electronically scanned array (aka phased array) applications, mounted to the fuselage or wing of aircraft to increase system functionality.

The tunable antenna 100 may be utilized for electronic warfare (EW) and/or surveillance. Additionally, the tunable antenna 100 may be utilized in other applications, such as signals intelligence (SIGINT) (e.g., intelligence gathering by the interception of sensitive or encrypted information), broadband reconfigurable systems, and/or broadband connectivity airborne Ka band satellite communication systems.

The methods disclosed may be implemented as sets of instructions, through a single production device, and/or through multiple production devices. Further, it is understood that the specific order or hierarchy of steps in the methods disclosed are examples of exemplary approaches. Based upon design preferences, it is understood that the specific order or hierarchy of steps in the method can be rearranged while remaining within the scope and spirit of the disclosure. The accompanying method claims present elements of the various steps in a sample order, and are not necessarily meant to be limited to the specific order or hierarchy presented.

It is believed that the present invention and many of its attendant advantages will be understood by the foregoing description, and it wilt be apparent that various changes may be made in the form, construction and arrangement of the components thereof without departing from the scope and spirit of the disclosure or without sacrificing all of its material advantages. The form herein before described being merely an explanatory embodiment thereof, it is the intention of the following claims to encompass and include such changes.

What is claimed is:

1. A tunable antenna comprising:

a conductor;

a shunt inductance tuning element;

a switch that controls the shunt inductance tuning element and the conductor;

a local ground connected to the shunt inductance tuning element;

at least a second shunt inductance tuning element, wherein the shunt inductance tuning element and the at least the second shunt inductance tuning element are positioned in a line that extends radially outward from a centered coaxial input and the switch is capable of activating the shunt inductance tuning element to change a frequency and bandwidth of the tunable antenna.

2. The tunable antenna as claimed in claim 1, wherein the tunable antenna is utilized in a software defined radio system.

3. The tunable antenna as claimed in claim 1, further comprising at least one of microelectromechanical variable capacitors, ferroelectric variable capacitors, and switch length transmission line stubs.

4. The tunable antenna as claimed in claim 1, wherein the tunable antenna is tunable across at least one of a VHF band, an UHF band, a SHF band, or an EHF band with a greater than 5 to 1 resonant frequency.

5. The tunable antenna as claimed in claim 1, wherein the tunable antenna has a diameter of 0.14 wavelength and a height 0.01 wavelength of the wavelength being transmitted and received by the tunable antenna at a frequency of about 300 MHz.

6. The tunable antenna as claimed in claim 1, wherein the tunable antenna has a diameter equal to about 1/10 a wavelength being transmitted and received by the tunable antenna at a lower operating frequency of the tunable antenna.

7. The tunable antenna as claimed in claim 1, wherein the tunable antenna is mountable to a surface and extends a distance at least as far as the distance the local ground extends from the surface.

8. The tunable antenna as claimed in claim 1, wherein the tunable antenna is vertically polarized.

9. The tunable antenna as claimed in claim 1, wherein the tunable antenna is horizontally polarized.

10. The tunable antenna as claimed in claim 1, further comprising a platform ground, wherein the platform ground is at least one of a fuselage, a wing, or a pod of an aircraft.

11. The tunable antenna as claimed in claim 1, wherein the switch comprises at least one of a microelectromechanical system, a PIN, or a transistor.

12. The tunable antenna as claimed in claim 1, further comprising:

a first tunable radiating element comprising the conductor, the shunt inductance tuning element, the switch, and the local ground; and at least a second tunable radiating element comprising a conductor, a shunt inductance tuning element, a switch and a local ground, wherein the first tunable radiating element and the at least the second tunable radiating element are configured to form an array.

13. The tunable antenna as claimed in claim 1, further comprising:

a first tunable radiating element comprising the conductor, the shunt inductance tuning element, the switch, and the local ground; and at least a second tunable radiating element comprising a conductor, a shunt inductance tuning element, a switch and a local ground, wherein the first tunable radiating element and the at least the second tunable radiating element are configured to form an array, and wherein the tunable antenna is electrically scanned.

14. A tunable antenna comprising:

a conductor;

a shunt inductance tuning element;

a switch that controls the shunt inductance tuning element and the conductor;

a local around connected to the shunt inductance tuning element;

a second shunt inductance tuning element;

a third shunt inductance tuning element;

a fourth shunt inductance tuning element;

a fifth shunt inductance tuning element;

a sixth shunt inductance tuning element;

a seventh shunt inductance tuning element; and an eighth shunt inductance tuning element, wherein the shunt inductance tuning element, the second shunt inductance tuning element, the third shunt inductance tuning element, the fourth shunt inductance tuning element, the fifth shunt inductance tuning element, the sixth shunt inductance tuning element, the seventh shunt inductance tuning element, and the eighth shunt inductance tuning element are positioned in two perpendicular lines that extend radially outward from a centered coaxial input, the switch is capable of activating the shunt inductance tuning element to change a frequency and bandwidth of the tunable antenna.

15. A tunable antenna comprising:

a conductor;

a shunt inductance tuning element;

a switch that controls the shunt inductance tuning element and the conductor;

a local around connected to the shunt inductance tuning element;

a first tunable radiating element comprising the conductor, the shunt inductance tuning element, the switch, and the local ground; and at least a second tunable radiating element comprising a conductor, a shunt inductance tuning element, a switch and a local ground, wherein the first tunable radiating element and the at least the second tunable radiating element are configured to form an array, and wherein the conductor of the first tunable radiating element is parallel and adjacent to the local ground of the at least the second tunable radiating element and a centered coaxial cable connects the first tunable radiating element to the at least the second tunable radiating element, the switch is capable of activating the shunt inductance tuning element to change a frequency and bandwidth of the tunable antenna.

16. A tunable antenna comprising:

a conductor;

a shunt inductance tuning element;

a switch that controls the shunt inductance tuning element and the conductor;

a local around connected to the shunt inductance tuning element;

a first tunable radiating element comprising the conductor, the shunt inductance tuning element, the switch, and the local ground; and at least a second tunable radiating element comprising a conductor, a shunt inductance tuning element, a switch and a local ground, wherein the first tunable radiating element and the at least the second tunable radiating element are configured to form an array, and wherein at least one of the switch in the first tunable radiating element or the switch in the at least the second tunable radiating element is capable of activating the shunt inductance tuning element in the first tunable radiating element or in the second tunable radiating element to compensate for parasitic mutual coupling in the array, the switch is capable of activating the shunt inductance tuning element to change a frequency and bandwidth of the tunable antenna.

17. A tunable antenna comprising:

a conductor;

a shunt inductance tuning element;

a switch that controls the shunt inductance tuning element and the conductor;

a local around connected to the shunt inductance tuning element;

a first tunable radiating element comprising the conductor, the shunt inductance tuning element, the switch, and the local ground; and at least a second tunable radiating element comprising a conductor, a shunt inductance tuning element, a switch and a local ground, wherein the first tunable radiating element and the at least the second tunable radiating element are configured to form an array, wherein at least one of the switch in the first tunable radiating element is capable of activating the shunt inductance tuning element in the first tunable radiating element or the switch in the at least the second tunable radiating element is capable of activating the shunt inductance tuning element in the second tunable radiating element to compensate for parasitic mutual coupling in the array, and wherein the array is utilized in a wide scan end fire electronically scanned antenna application, the switch is capable of activating the shunt inductance tuning element to chance a frequency and bandwidth of the tunable antenna.

* * * * *